US007469930B2

(12) United States Patent
Thomsen

(10) Patent No.: US 7,469,930 B2
(45) Date of Patent: Dec. 30, 2008

(54) WINDOW ALBUM

(75) Inventor: David J. Thomsen, Annandale, MN (US)

(73) Assignee: The Antioch Company, St. Cloud, MN (US)

( * ) Notice: Subject to any disclaimer, the term of this patent is extended or adjusted under 35 U.S.C. 154(b) by 174 days.

(21) Appl. No.: 10/592,647

(22) PCT Filed: Mar. 15, 2005

(86) PCT No.: PCT/US2005/008520

§ 371 (c)(1),
(2), (4) Date: Sep. 13, 2006

(87) PCT Pub. No.: WO2005/089300

PCT Pub. Date: Sep. 29, 2005

(65) Prior Publication Data

US 2007/0200334 A1 Aug. 30, 2007

Related U.S. Application Data

(60) Provisional application No. 60/554,000, filed on Mar. 16, 2004, provisional application No. 60/558,442, filed on Mar. 31, 2004.

(51) Int. Cl.

| | |
|---|---|
| ***B42D 5/00*** | (2006.01) |
| ***B42D 1/00*** | (2006.01) |
| ***B42D 3/00*** | (2006.01) |
| ***B42F 3/00*** | (2006.01) |
| ***B42F 13/40*** | (2006.01) |
| ***B42F 13/00*** | (2006.01) |
| ***A47G 1/06*** | (2006.01) |

(52) U.S. Cl. ..... 281/15.1; 281/29; 281/31; 402/3; 402/4; 402/73; 40/726

(58) Field of Classification Search ..... 281/15.1, 281/29, 31; 402/3, 4, 73; 40/726
See application file for complete search history.

(56) References Cited

U.S. PATENT DOCUMENTS

| | | | | |
|---|---|---|---|---|
| 2,186,643 | A * | 1/1940 | Kaplan | 40/781 |
| 2,521,792 | A * | 9/1950 | Hollander | 206/0.83 |
| 4,164,085 | A * | 8/1979 | Steeb et al. | 40/726 |
| 4,434,567 | A | 3/1984 | LeVeau | |
| 4,905,821 | A | 3/1990 | Corbett | |
| 5,437,514 | A * | 8/1995 | Minch | 402/79 |
| 5,662,447 | A | 9/1997 | Tsai | |
| 5,913,541 | A | 6/1999 | Chen | |
| 6,045,161 | A * | 4/2000 | Ashcraft et al. | 281/37 |
| 6,145,882 | A * | 11/2000 | Fu | 281/22 |

* cited by examiner

*Primary Examiner*—Dana Ross
*Assistant Examiner*—Kyle Grabowski
(74) *Attorney, Agent, or Firm*—Moore & Hansen, PLLP

(57) ABSTRACT

An album (10) for photographs and similar collectible items comprising a cover (1) in which at least one window (2) is formed for display of a photograph or other flat object. The window is formed by a window frame mounting base (102) having an L-shaped cross sectional profile and a window frame cover (101) having an L-shaped cross-sectional profile.

21 Claims, 13 Drawing Sheets

WINDOW ALBUM

CROSS-REFERENCE TO RELATED APPLICATIONS

This application claims the benefit of U.S. Provisional Patent Applications No. 60/554,000 filed Mar. 16, 2004 and 60/558,442 filed Mar. 31, 2004.

TECHNICAL FIELD

This invention concerns albums for photographs and similar collectable items.

BACKGROUND

One type of high-quality loose-leaf album comprises a pair of covers enfolding a plurality of replaceable leaves for photographs or similar memorabilia, the covers and leaves being laced together by straps which lace through hinge elements projecting from the leaves, and also through slots in holders attached to the inside of the covers. The cover holders frictionally hold the ends of the straps. See, for example, U.S. Pat. No. 5,848,851 (Gunasekera).

SUMMARY OF THE INVENTION

The invention is an album for photographs and similar collectable items, having a cover in which at least one window is formed for the display of a photograph or other flat object. The displayed object is held in a pocket, which is formed from an upper transparent polymeric material that has been adhered or otherwise attached around three sides of its perimeter to a lower material (preferably paper), which in turn is completely affixed to the inner base card layer of the cover. A framed cutout in the cover displays the object, recessed within the cover due to the depth of the material forming the cover.

In particular, the invention is an album for photographs, having at least one cover in which at least one window opening is formed, in which the window is formed by a window frame mounting base having a L-shaped cross-sectional profile and inserted into the window opening from an inside of the cover. The album further comprises a window frame cover having a L-shaped cross-sectional profile that is inverted with respect to the profile of the window frame mounting base. The window fram cover is inserted into the window opening from an outside of the cover, and mates with the window frame mounting base such that outer-facing portions of the window frame cover exposed edges of the window frame mounting base. Thus, no seams are visible in normal use, as viewed from the outside of the cover, even when the album is viewed from an angle.

BRIEF DESCRIPTION OF THE DRAWINGS

The accompanying drawings show a particular embodiment of the invention as an example, and are not intended to limit the scope of the invention. In particular, the dimensions on the figures are preferred but not required except as specifically set forth in the claims. The dimensions are only a guide to the proportions of the components of the invention and how they interrelate with each other, or fit together in some cases.

FIGS. 2-3 are front views of components of the preferred embodiment of FIG. 1.

DETAILED DESCRIPTION

In general terms, the invention is an improved version of the photograph album disclosed and claimed in U.S. Pat. No. 5,848,851 (Gunasekera), the entire contents of which are incorporated by reference. Unless specified otherwise below, the construction of the invention is as described in the Gunasekera patent.

The invention further includes a window formed in the material of one or both of the front and back covers of the album, preferably the front cover. The location of the window is not critical to the scope of the invention, but it is preferred for aesthetic reasons to place the window generally centered both horizontally and vertically in the front cover. The shape of the window is not critical to the scope of the invention but it is preferred that it be rectangular. The orientation of the window is not critical to the scope of the invention but it is preferred that it be portrait, as opposed to landscape. The size of the window is not critical to the scope of the invention, but for an especially preferred rectangular and portrait window centered on the front of a cover measuring approximately twelve inches in width (not including the spine of the album) and approximately twelve and one-half inches in height, a window having inside dimensions of five and one-half inches in height and three and one-half inches in width is preferred.

The size of the window frame is not critical to the scope of the invention, but for the especially preferred rectangular and portrait window just described, a window frame width of approximately seven-sixteenths inch on all visible exterior sides is preferred. The depth of the window frame is not critical to the scope of the invention, and will be dictated by the available thickness of the cover itself, but for the especially preferred rectangular and portrait window just described, a window thickness of approximately one quarter inch is preferred; the thickness of the window preferably is created by one leg of an L-shaped frame, as described farther below, and thus is a unitary piece constructed of the same material so that there are no seams or joints visible from the exterior of the album. The finish of the window frame is not critical to the scope of the invention, but for a dark colored album cover, a glossy silver finish is preferred.

Figure 1:
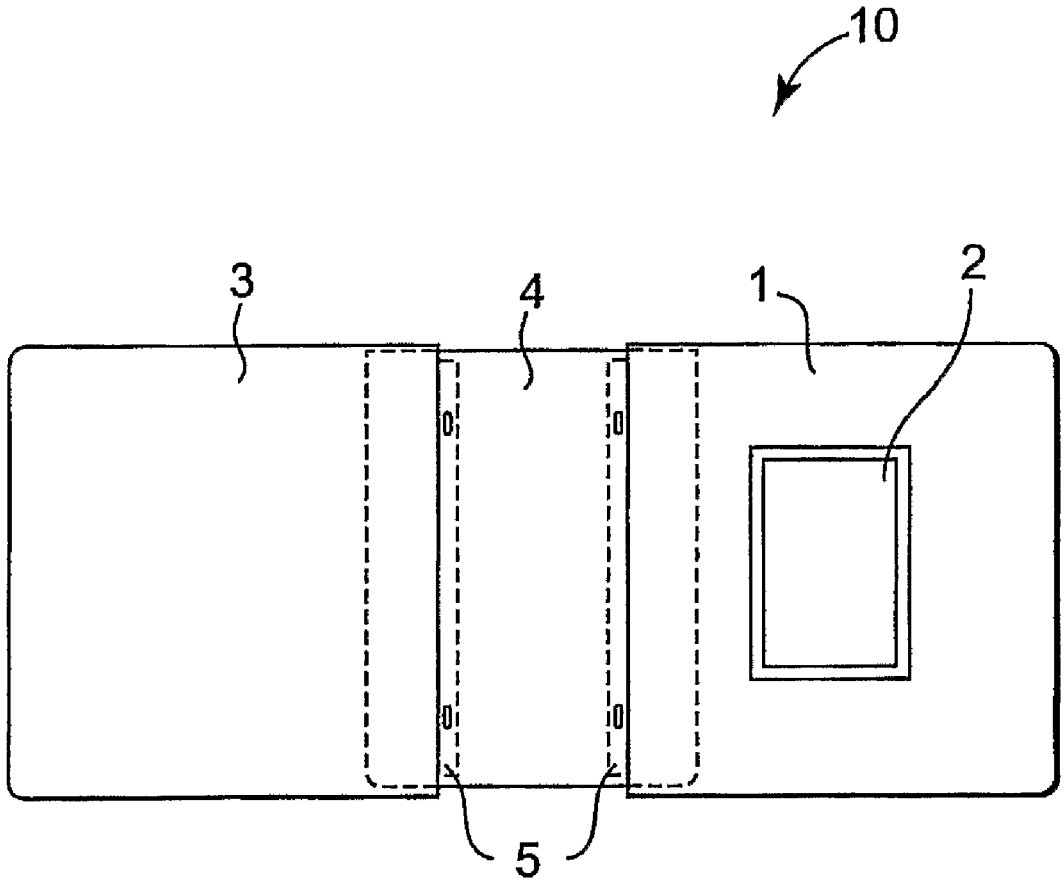
FIG. 1 is a front view of a preferred embodiment of the invention, opened and laid flat for ease of illustration.

FIG. 1 is a front view of album cover 10, which has been opened up and laid flat to show in this single view the exterior of each of front cover 1, window frame 2 located in front cover 1, back cover 3, and flexible backbone 4. Front cover 1, back cover 3, and flexible backbone 4 are separate pieces which are assembled into an album by inserting opposite ends of flexible backbone 4 into the respective interiors of front cover 1 and back cover 3.

Figure 2A:
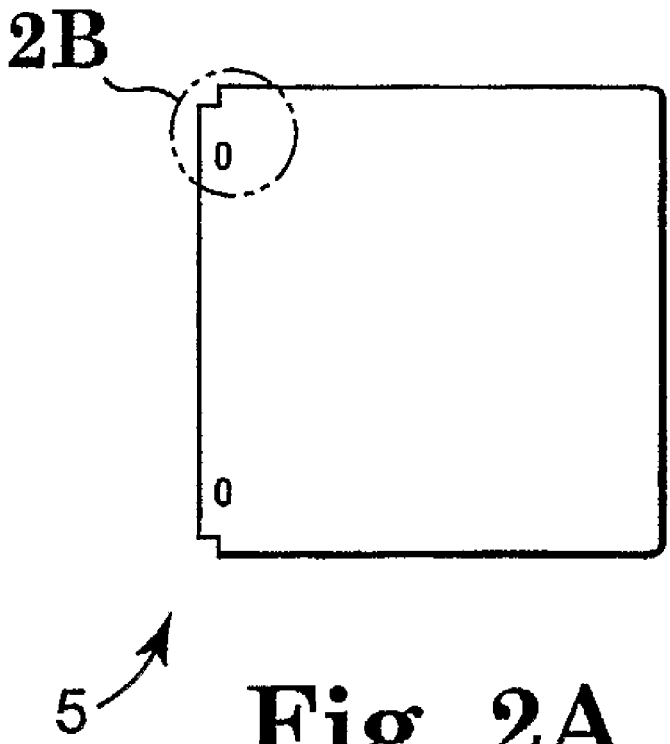
FIG. 2 is a front views of a component of the preferred embodiment of FIG. 1, including the detail view A taken at the location illustrated.
Figure 2B:
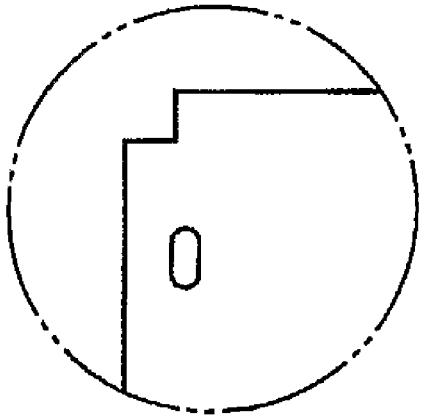

FIG. 2 is a front view of a portion of front cover 1, specifically the inner base card 5 that lies within front cover 1. (Another inner base card 5 lies within back cover 3.) As can be seen in the detail portion of the figure denoted A, this piece is slotted so that the strap that will hold the removable leaves within completed album 10 will also pass through the slots in the covers, as is known from the Gunasekera patent noted above.

Figure 3:
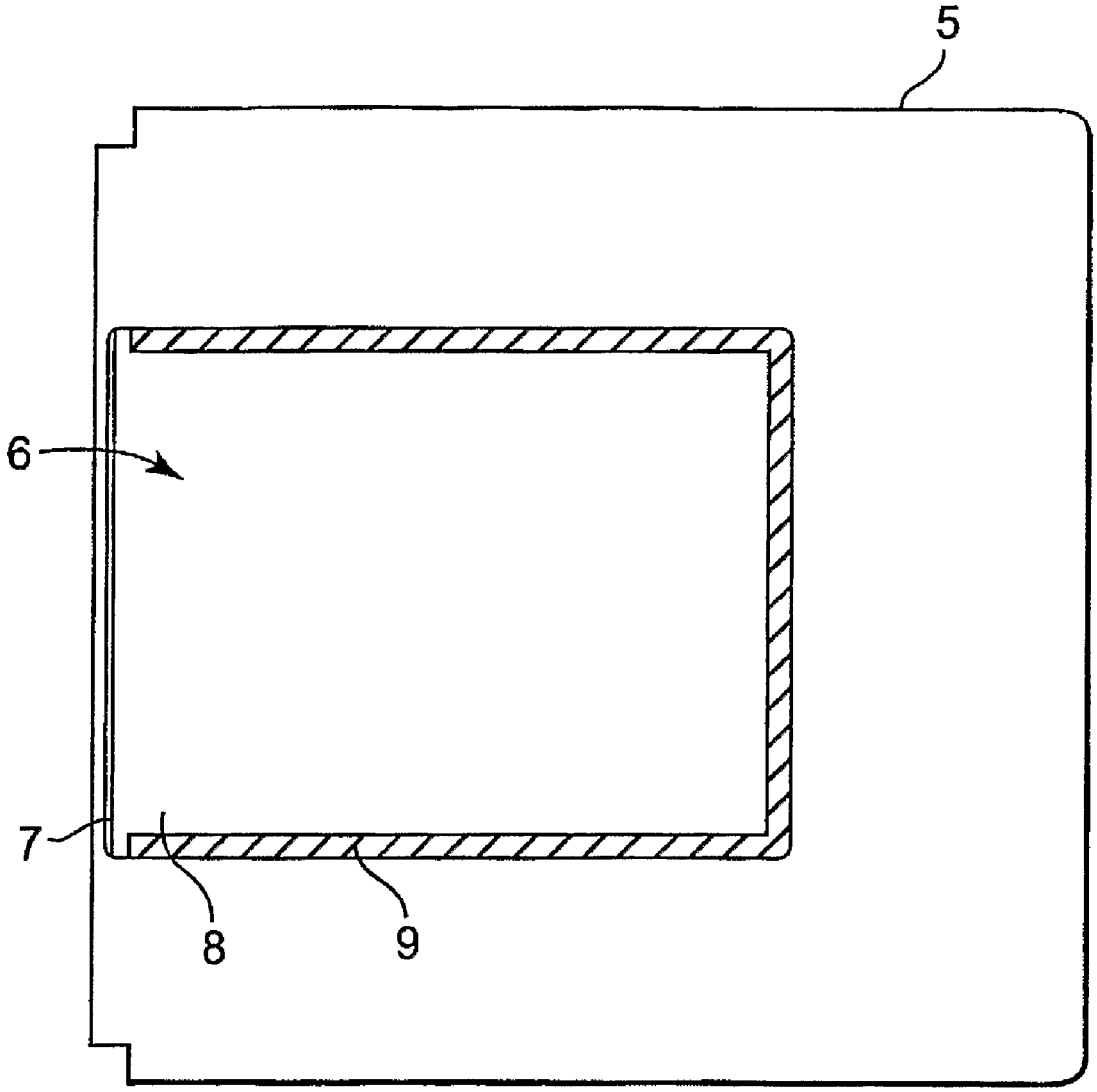

FIG. 3 is a detailed dimensioned view of inner base card 5 (without slots as just described). Pocket 6 is formed from a lower layer 7 formed from a photo-safe material (e.g., paper), while upper layer 8 is typically transparent (it could be merely translucent) but otherwise is also a photo-safe material such as polypropylene or polyester. Because upper layer 8 will be ultimately exposed to the outside of the album, it should be a material that can withstand conditions such as exposure to sunlight (in terms of fading, yellowing, wrinkling, other disadvantages caused by light exposure and/or elevated temperatures, etc.) without losing its ability to both display and protect the underlying photograph or other object in pocket 6. The two layers 7, 8 are fused or otherwise adhered together on three sides in adhesive region 9, such as by thermal lamination or by use of a separate adhesive material, including UV-curable adhesives (although other types of adhesives may be employed). The fourth side is open so that the photograph or other displayed object may be inserted and removed. Pocket 6 is adhered or otherwise permanently attached to inner base card 5, preferably by applying an adhesive with a removable liner to the back side of the photo pocket 6. The liner is removed, and the photo pocket is applied to the base card. Regardless of how it is attached, it must be aligned with the window so that, once the entire album front cover is assembled, the contents of pocket 6 may be viewed through the window 2 of the front cover 1. This step may be incorporated into the process of assembling the remainder of the album, or it may be done separately so that an inventory of pre-assembled units is provided.

Figure 8C:
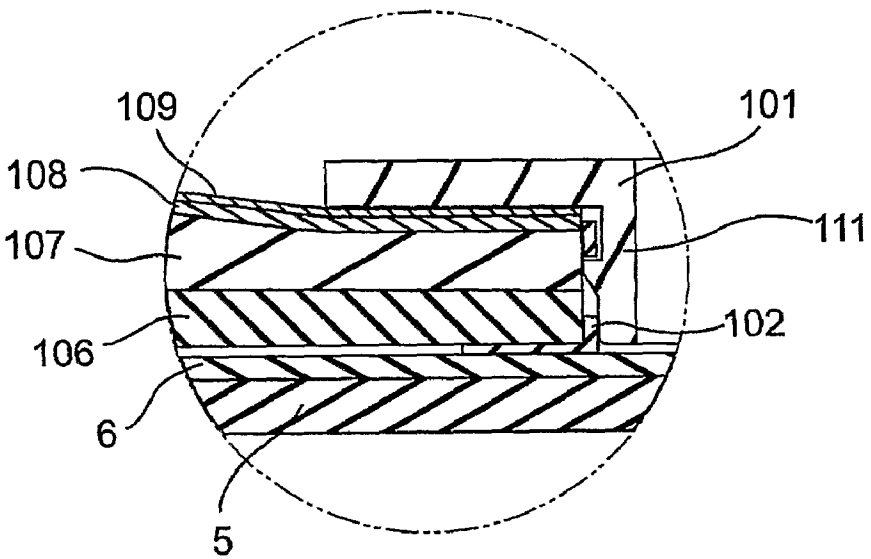
FIG. 8 is a front view of the front cover component of FIG. 1, including a cross-sectional view taken along the line 8-8, and a detail view A taken from the cross-sectional view at the location illustrated.
Figure 8A:
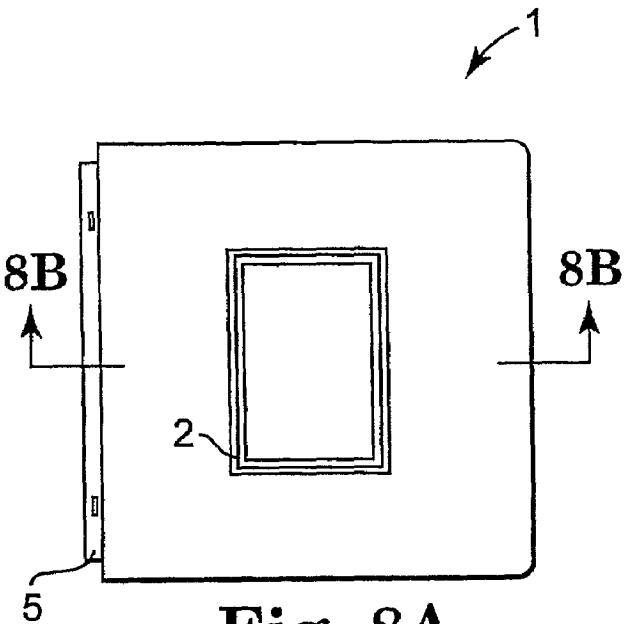
Figure 8B:
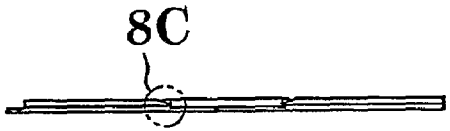
Figure 9C:
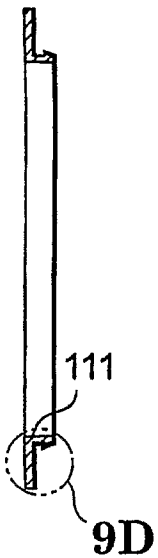
FIG. 9 is a collection of front and side views of the window frame component of FIG. 8, including a cross-sectional view taken along the line A-A, and a detail view K taken from the cross-sectional view at the location illustrated.
Figure 9B:
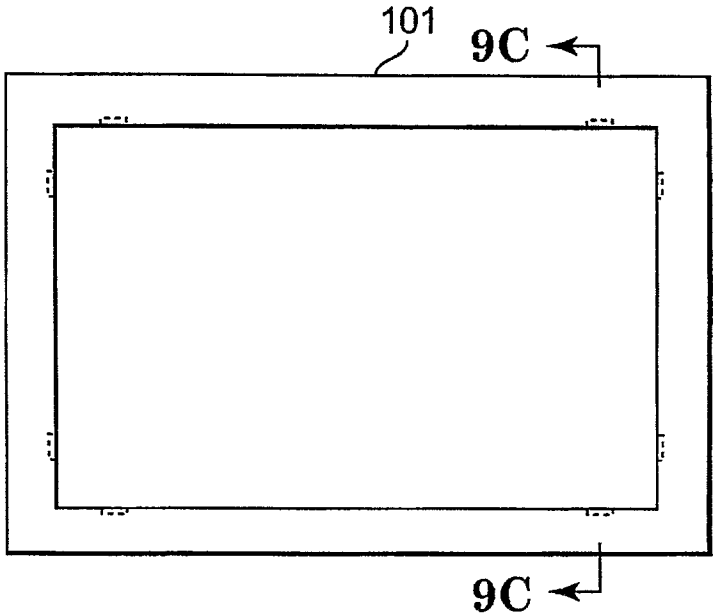
Figure 9D:
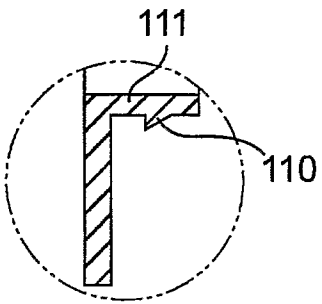
Figure 9A:
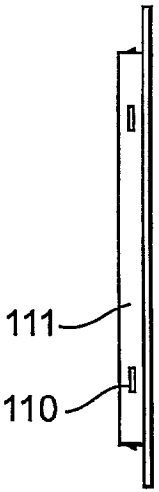

FIG. 8 illustrates the assembled front cover, including dimensions for the preferred embodiment, although the scope of the invention is not limited to these dimensions. The back cover is the same as the front cover, but without the window, and thus is not shown but should be understood as part of an assembled album. The preferred components and construction of the front cover are illustrated in detail A of FIG. 8: window frame 101, preferably but not necessarily manufactured of zinc alloy; window frame mounting base 102, preferably but not necessarily manufactured of stainless steel, and to which window frame 101 attaches to form window 2 of FIG. 1; inner base card 5; pocket 6; lower cardboard 106; sponge or foam board 107; upper cardboard 108 (which may or may not be necessary depending on the application), and exterior cover material 109. The composition of these materials is not critical to the scope of the invention, and also would be understood by those skilled in the art of manufacturing album covers of this type.

Figure 4A:
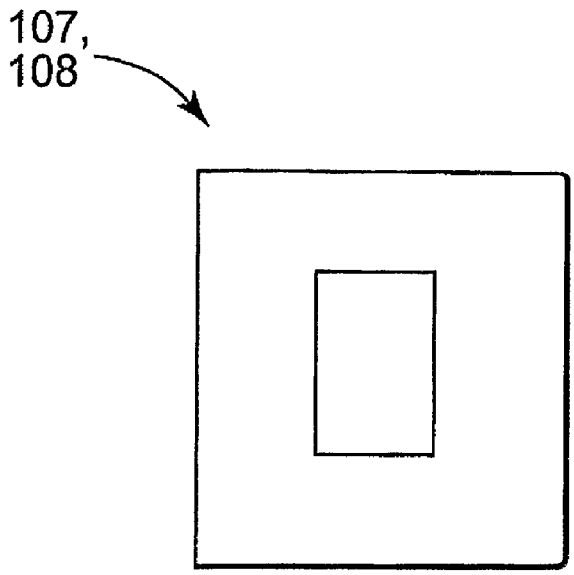
FIG. 4 is a collection of front and bottom views of component(s) of the preferred embodiment of FIG. 1, including the detail view A taken from the bottom view at the location illustrated.
Figure 4B:
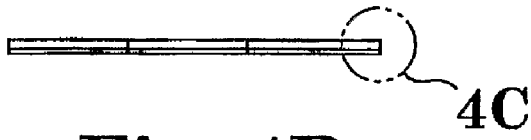
Figure 4C:
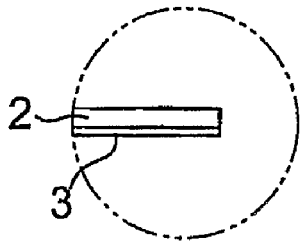

FIG. 4 is a detailed view of components such as sponge or foam board 107, upper cardboard 108, and the like, illustrating that each has a hole, punched or cut in a conventional manner, and having the required size and location to accommodate window 2 and its other components. An appropriate set of one or more cuts or cutouts is made in exterior cover material 109 to be compatible with the holes formed in the other components of the cover. Exterior cover material 109 may be laminated or adhered to foam board 107, upper cardboard 108 (if used), and the like along the perimeter of window 2 using conventional techniques.

Figure 10B:
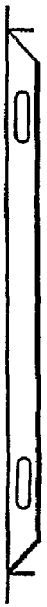
FIG. 10 is a collection of top, front, and side views of the mounting corner component of FIG. 8.
Figure 10A:
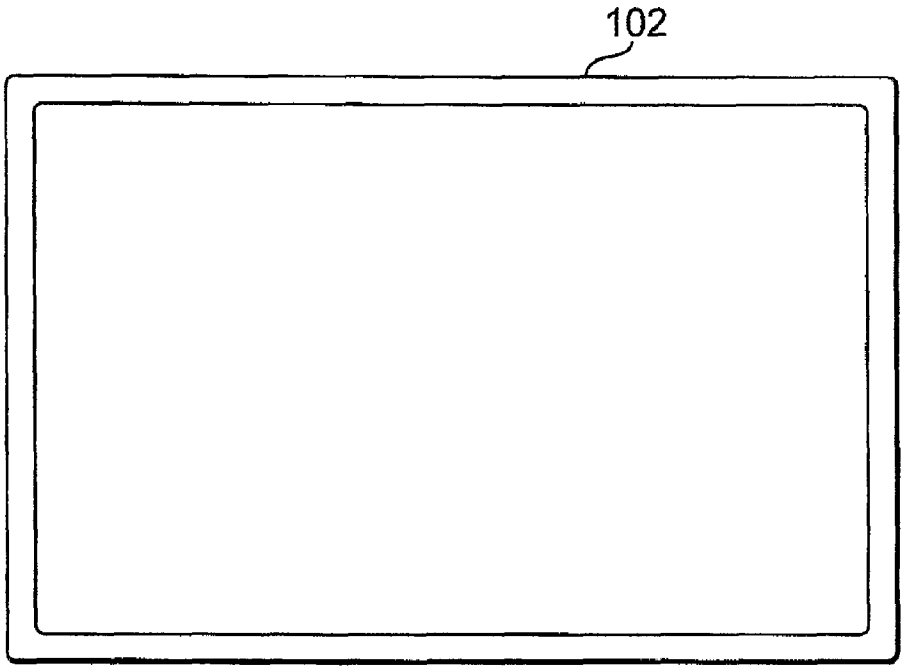
Figure 10C:
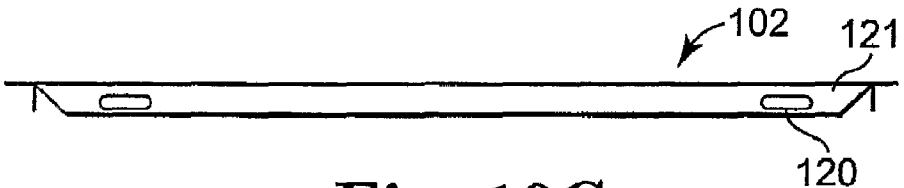

Referring back to FIG. 8, the window frame 2 is assembled from the window frame 101 and window frame mounting base 102, which are shown in more detail in FIGS. 9 and 10, respectively. In cross section, each piece is L-shaped, such that the window frame mounting base 102 is inserted into the window opening from below, and the window frame 101, its L-shaped profile inverted with respect to the profile of the lower piece, is then inserted into the window opening from above, and the two pieces connect together. This enables the portions of the outer-facing window frame 101 to cover the exposed edges of the window frame mounting base 102, thereby revealing no seams in normal use as viewed from the exterior front of the album, even when the album is viewed from an angle.

The window frame 101 and window frame mounting base 102 connect together in any convenient manner that does not expose seams or other construction features, as described above. The preferred technique for connecting the two pieces together uses one or more teeth 110 formed in any or all of the downwardly directed legs 111 of window frame 101. In the preferred embodiment, there are two teeth 110 formed in each of the four downwardly directed legs 111, but the number of teeth per leg and the number of legs having such teeth are each matters of preference and not limitations of the scope of the invention. Also, the preferred teeth are separate from each other and located generally toward the corners of the window frame 101 (i.e., near where adjacent downwardly directed legs 111 meet), but these are also preferences and not requirements of the invention. For example, an elongated ridge that extends over much or all of the extent of a downwardly directed leg 111 is within the scope of the invention. Similarly, a pair of teeth, matched in size and shape or not matched if so desired, could be provided adjacent each corner.

Mating features 120 are provided in upwardly directed legs 121 of the window frame mounting base 102. The features are sized and located to provide a snap fit with the teeth 110 of window frame 101. In the preferred embodiment, there are two openings 120 formed in each of the four upwardly directed legs 121, but the number of openings or other snap features (such as a ridge or groove) per leg and the number of legs having such features are determined by the need for the two frame pieces 101 and 102 to be compatible with each other. Also, the preferred openings are discrete and separate from each other, again located generally toward the corners of the window frame mounting base 102, but as before these are also preferences and not requirements of the invention. For example, an extended slot or ridge that extends over much or all of the extent of the upwardly directed leg 121 is within the scope of the invention. The size, number, configuration and the like of teeth 110 and openings 120 may be selected to balance ease of construction, the integrity of the finished product, and similar product design considerations, all while remaining within the scope of the invention.

Figure 11C:
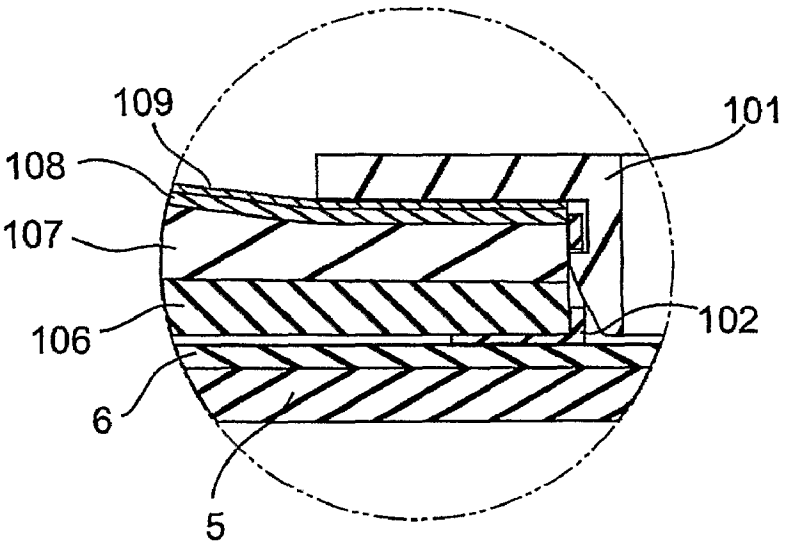
FIG. 11 is a front view of an alternative embodiment of the front cover component of FIG. 1, including cross-sectional views taken along the lines 11-11, and A-A at the locations illustrated.
Figure 11A:
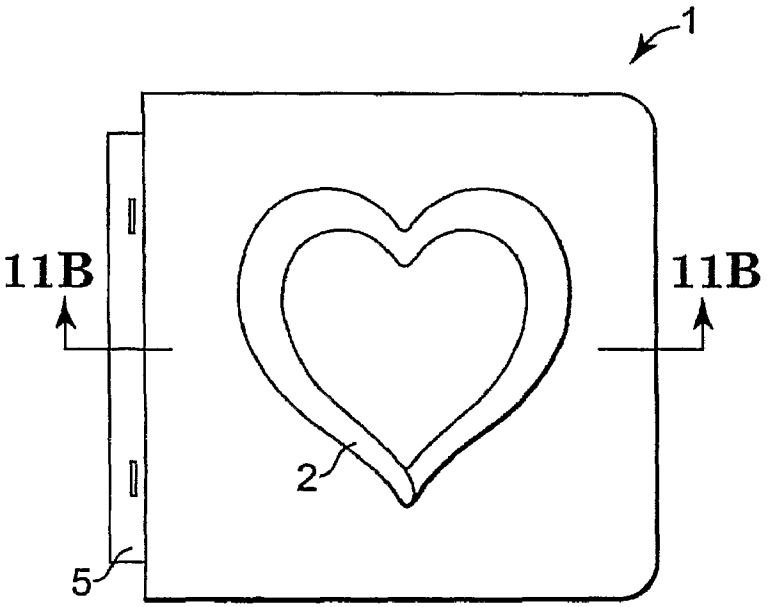
Figure 11B:
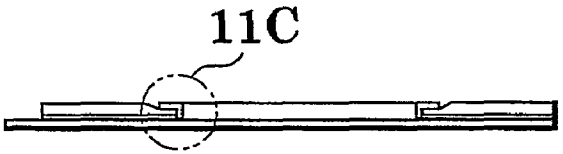
Figure 12B:
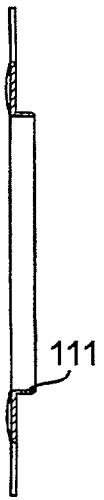
FIG. 12 is a collection of front and side views of the window frame component of FIG. 11, including a cross-sectional view taken along the line A-A.
Figure 12A:
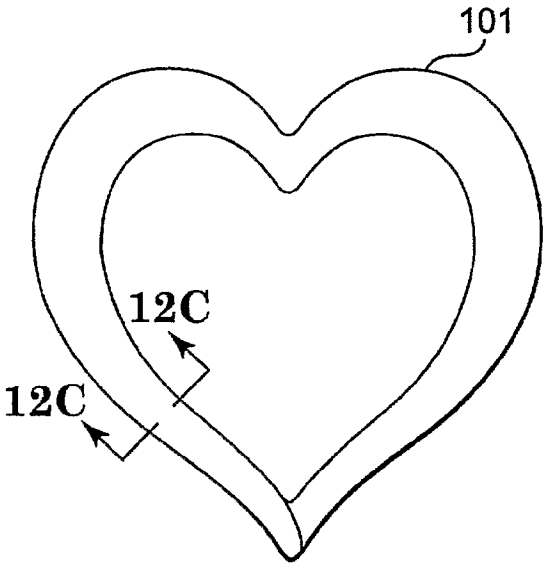
Figure 12C:
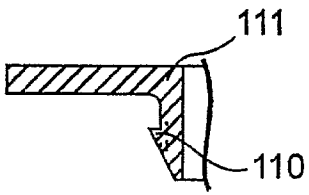
Figure 13B:
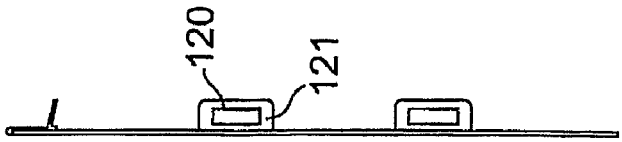
FIG. 13 is a collection of top and side views of the mounting corner component of FIG. 11, including a detail view A taken at the location illustrated.
Figure 13A:
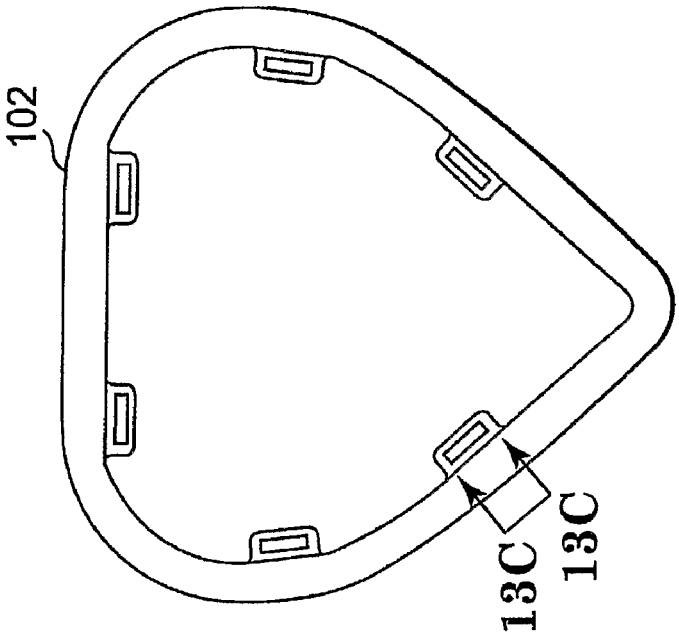
Figure 13C:
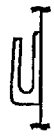

FIGS. 11-13 are similar to FIGS. 8-10, respectively, with like numbered components corresponding to each other and illustrating an alternative embodiment in which the shape of a window is a heart instead of a rectangle. This embodiment also features discrete tabs, as opposed to a feature that runs the entire length of a side of component of the frame, house teeth 110 and mating features 120. The use of discrete tabs is not limited to the heart shaped embodiment, and therefore could be employed in the rectangular shaped embodiment of FIGS. 8-10 or in any other embodiment of the invention having a differently shaped frame. This set of figures also illustrates that the window frame may, in general, be curved as opposed to rectilinear. Thus, ovals, circles, squares, triangles, flower shapes, and other figures are within the scope of the invention even though they are not specifically illustrated.

The exterior cover material 109 may be gathered around the four exterior sides of the front cover and adhered underneath the visible exterior of the front cover using conventional techniques, such as pulling it taught and adhering it in place. On the side from which the base card 5 extends, the cover material 109 is adhered to the bottom side of lower cardboard 106 so that the slotted portion of base card 5 may extend outward from the front cover; access to the insert or remove the photograph is available on the other (upper) face of base card 5 but below the exterior cover material 109 and the bottom side of lower cardboard 106. (This is also the location into which the backbone 4 is inserted, as described elsewhere, and thus backbone 4 lies atop the entrance to pocket 6.) On the other three sides, the exterior cover material 109 may be adhered to the bottom side of lower cardboard 106, and optionally (but preferably) the edges of exterior cover material 109 are covered by a suitable back piece (not shown) that also serves as the visible interior of the entire front cover. The back piece is adhered around as least its perimeter to the exterior cover material and/or the bottom face of lower cardboard 106.

Figure 5:
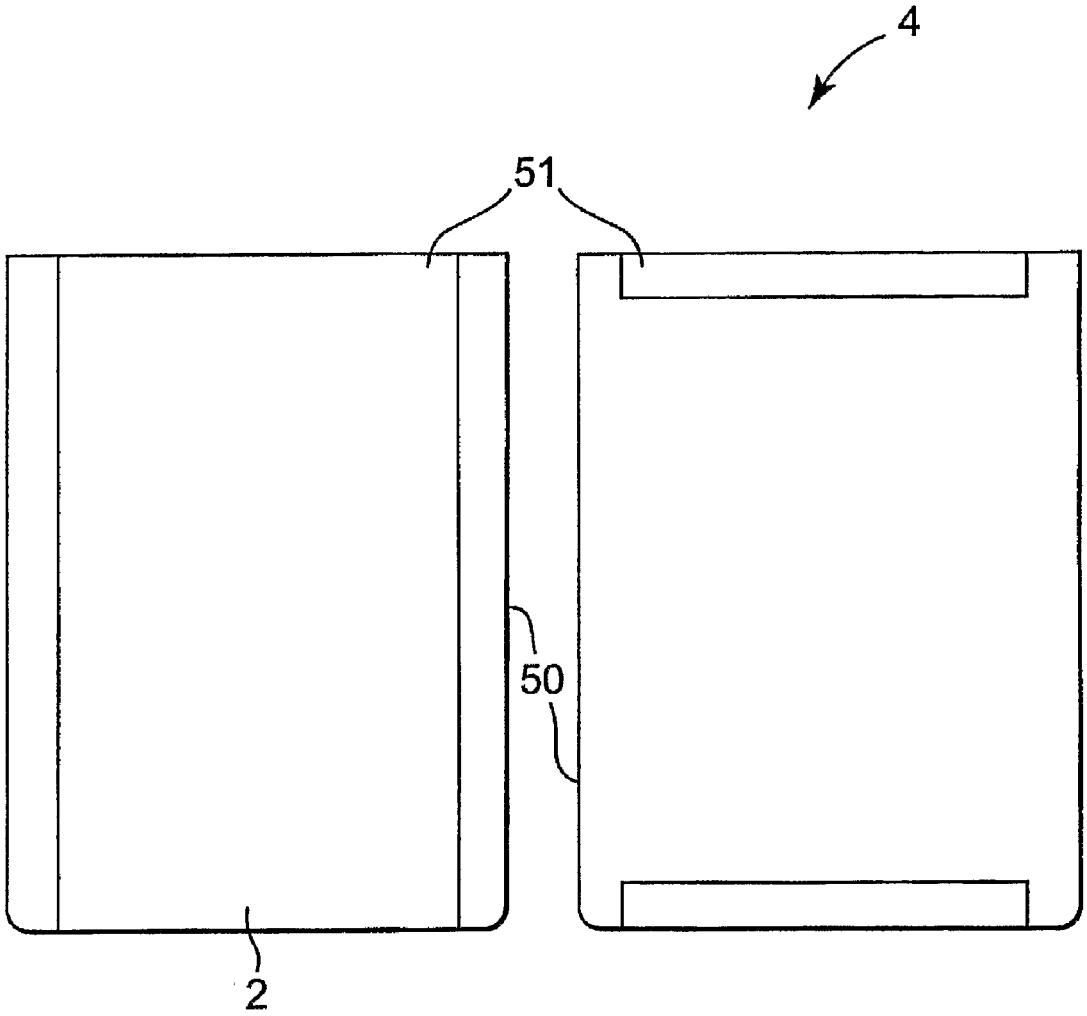
FIG. 5 is a collection of front and back views of a component of the preferred embodiment of FIG. 1.
Figure 6:
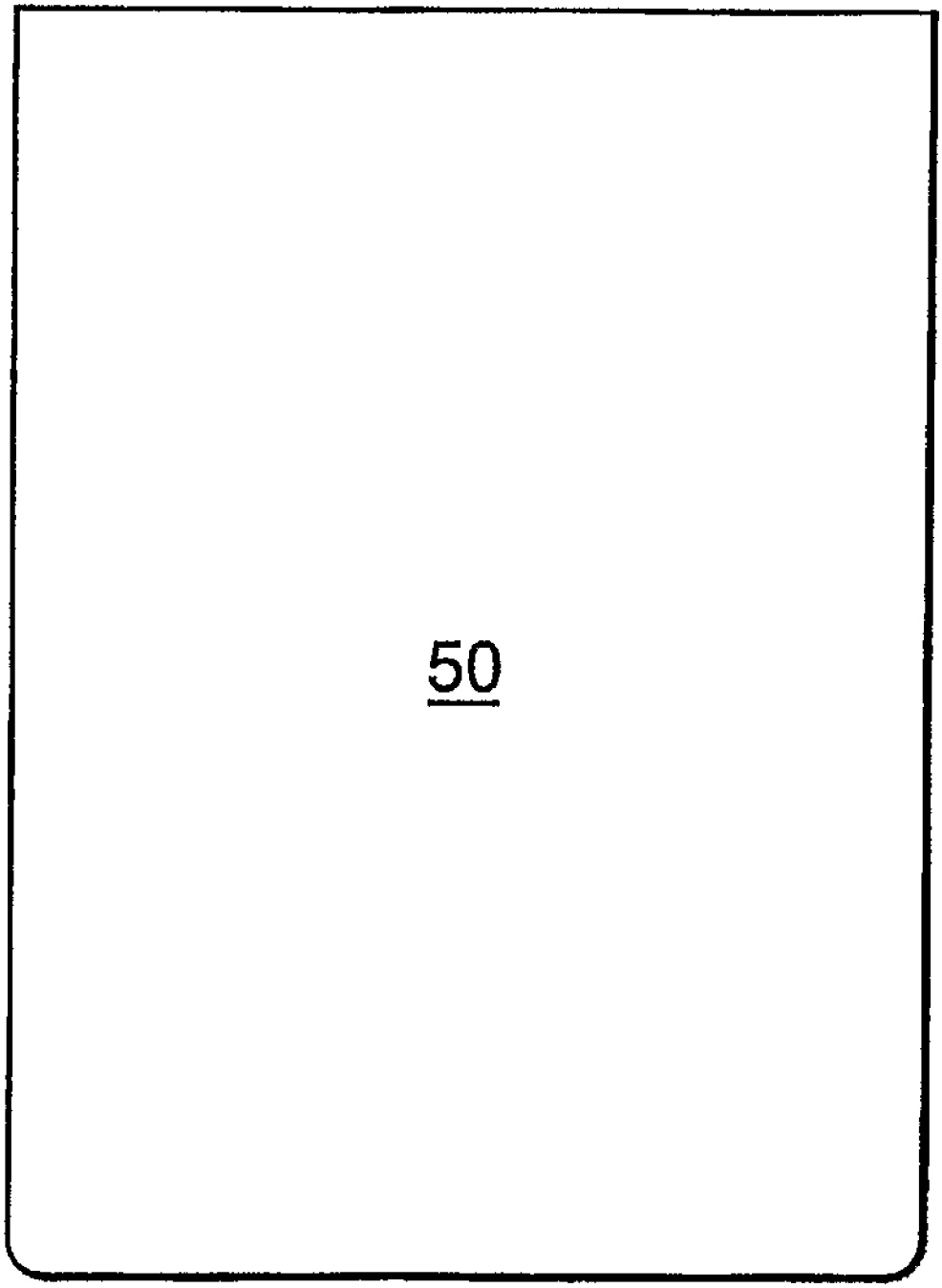
FIGS. 6-7 are front views of components of the preferred embodiment of FIG. 1.
Figure 7:
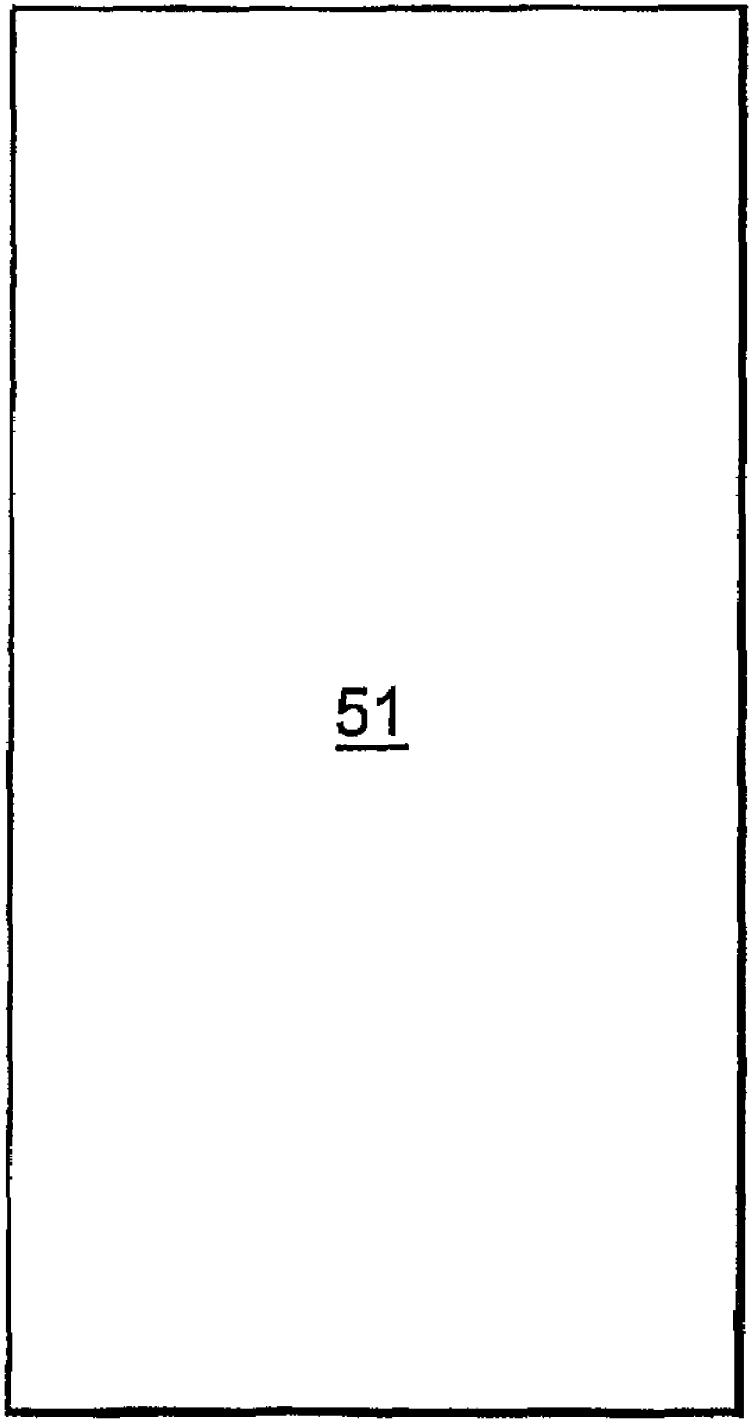

FIGS. 5-7 are views of the components of the backbone. FIG. 5 shows front and back views of the backbone, which comprises a base backbone material 50 (such as a flexible card stock) to which has been adhered, using any convenient method, and a backbone bookcloth 51 (which typically is the same material as the exterior cover material 109 used on the front and back covers). FIGS. 6 and 7 show dimensions for these materials in the preferred embodiment, but backbones having other configurations and dimensions are possible in other embodiments of the invention.

I claim:

1. An album for photographs, having at least one cover into which is formed at least one window opening having inside faces and a center, the window opening being framed by a window frame mounting base having a L-shaped cross-sectional profile and inserted into the window opening from an inside of the album cover such that the base does not substantially extend toward the center of the window opening; and a window frame cover having a L-shaped cross-sectional profile inverted with respect to the profile of the window frame mounting base, and inserted into the window opening from an outside of the cover to mate with the window frame mounting base such that outer-facing portions of the window frame cover prevent exposure of edges of the window frame mounting base when viewed from the outside of the cover.

2. The album of claim 1, in which the window frame cover comprises at least one tooth formed in a downwardly directed leg of the window frame cover.

3. The album of claim 1, further comprising a mating feature provided in an upwardly directed leg of the window frame mounting base, the feature sized and located to provide a snap fit with the window frame cover.

4. The album of claim 3, in which the mating feature is at least one discreet tab.

5. The album of claim 1, in which the album cover in which the window is formed comprises an inner base card that lies within the album cover, attached to which is a pocket comprising a lower layer formed from a photo-safe material and a transparent or translucent upper layer, the lower and upper layers being joined together on three sides and the fourth side being open so that a photograph or other object may be inserted and removed.

6. The album of claim 5, in which the cover in which the pocket is permanently attached to the inner base card and aligned so that, once the entire album front cover is assembled, the contents of the pocket may be viewed through the window of the front cover.

7. The album of claim 1 in which the shape of the window opening is one of a rectangle, heart, oval, circle, square, triangle, and flower shape.

8. An album for photographs, comprising:

a) at least one album cover comprising a window opening having a perimeter and an open center;

b) a window frame, surrounding the perimeter of the window opening, comprising:

i) a mounting base, having a L-shaped cross-sectional profile, inserted into the window opening from an inside of the album cover such that the base does not substantially extend beyond the perimeter into the open center of the window opening; and ii) a window frame cover, having a L-shaped cross-sectional profile, inserted into the window opening from an outside of the album cover to mate with the window frame mounting base;

such that each L-shaped profile is inverted with respect to each other to conceal exposed edges of the window frame mounting base.

9. The album of claim 8, in which the mounting base and the window frame cover snap fit to each other.

10. The album of claim 8, further comprising a pocket, in turn comprising a lower photo-safe material and a transparent or translucent upper material, the lower and upper materials being joined together on not more than three sides to permit insertion or removal of an object; the pocket being permanently attached and aligned to the at least one album cover such that the object may be viewed through the window opening.

11. The album of claim 8, in which the shape of the window opening is one of a rectangle, heart, oval, circle, square, triangle, and flower shape.

12. An album for photographs, having at least one cover in which at least one window opening is formed, in which the window is formed by a window frame mounting base having a L-shaped cross-sectional profile and inserted into the window opening from an inside of the album cover; and a window frame cover having a L-shaped cross-sectional profile inverted with respect to the profile of the window frame mounting base, and inserted into the window opening from an outside of the cover to mate with the window frame mounting base such that outer-facing portions of the window frame cover exposed edges of the window frame mounting base; in which the album cover in which the window is formed comprises an inner base card that lies within the album cover, attached to which is a pocket comprising a lower layer formed from a photo-safe material and a transparent or translucent upper layer, the lower and upper layers being joined together on three sides and the fourth side being open so that a photograph or other object may be inserted and removed.

13. The album of claim 12, in which the cover in which the pocket is permanently attached to the inner base card and aligned so that, once the entire album front cover is assembled, the contents of the pocket may be viewed through the window of the front cover.

14. The album of claim 12, in which the window frame cover comprises at least one tooth formed in a downwardly directed leg of the window frame cover.

15. The album of claim 12, further comprising a mating feature provided in an upwardly directed leg of the window frame mounting base, the feature sized and located to provide a snap fit with the window frame cover.

16. The album of claim 15, in which the mating feature is at least one discreet tab.

17. The album of claim 12, in which the shape of the window opening is one of a rectangle, heart, oval, circle, square, triangle, and flower shape.

18. An album for photographs, comprising:

a) at least one album cover comprising a window opening;

b) a window frame, surrounding the window opening, comprising:

i) a mounting base, having a L-shaped cross-sectional profile, inserted into the window opening from an inside of the album cover; and ii) a window frame cover, having a L-shaped cross-sectional profile, inserted into the window opening from an outside of the album cover to mate with the window frame mounting base;

such that each L-shaped profile is inverted with respect to each other to conceal exposed edges of the window frame mounting base; and c) a pocket, comprising a lower photo-safe material and a transparent or translucent upper material, the lower and upper materials being joined together on not more than three sides to permit insertion or removal of an object; the pocket being permanently attached and aligned to the at least one album cover such that the object may be viewed through the window opening.

19. The album of claim 18, in which the window frame cover comprises at least one tooth formed in a downwardly directed leg of the window frame cover.

20. The album of claim 18, further comprising a mating feature provided in an upwardly directed leg of the window frame mounting base, the feature sized and located to provide a snap fit with the window frame cover.

21. The album of claim 20, in which the mating feature is at least one discreet tab.

* * * * *